US006805263B2

(12) United States Patent
Garcia et al.

(10) Patent No.: US 6,805,263 B2
(45) Date of Patent: Oct. 19, 2004

(54) FLUID PRODUCT DISPENSER

(75) Inventors: Firmin Garcia, Evreux (FR); Christophe Pierre, Evreux (FR)

(73) Assignee: Valois Sas, Le Neubourg (FR)

( * ) Notice: Subject to any disclaimer, the term of this patent is extended or adjusted under 35 U.S.C. 154(b) by 149 days.

(21) Appl. No.: 10/298,522

(22) Filed: Nov. 19, 2002

(65) Prior Publication Data

US 2003/0218024 A1 Nov. 27, 2003

Related U.S. Application Data

(60) Provisional application No. 60/350,026, filed on Jan. 23, 2002.

(30) Foreign Application Priority Data

Nov. 20, 2001 (FR) ..... 01 15005

(51) Int. Cl.[7] ..... B67D 5/52

(52) U.S. Cl. ..... 222/145.1; 222/633; 222/214; 222/153.03; 222/541.6

(58) Field of Search ..... 222/206, 212, 222/214, 215, 541.6, 153.09, 633, 130, 145.1, 145.2

(56) References Cited

U.S. PATENT DOCUMENTS

| | | | | | |
|---|---|---|---|---|---|
| 522,301 | A | * | 7/1894 | Negele | 222/214 |
| 1,908,540 | A | * | 5/1933 | Quimby | 222/107 |
| 1,942,248 | A | * | 1/1934 | George | 222/130 |
| 2,091,081 | A | * | 8/1937 | Sharpe | 222/633 |
| 2,096,920 | A | * | 10/1937 | Rose | 222/214 |
| 2,123,558 | A | * | 7/1938 | Althcide | 132/114 |
| 2,432,288 | A | * | 12/1947 | Abraham | 222/83 |
| 2,596,592 | A | * | 5/1952 | Parker | 222/92 |
| 2,788,921 | A | * | 4/1957 | Bernard | 222/212 |
| 3,847,370 | A | * | 11/1974 | Engelsher | 251/6 |
| 6,536,635 | B1 | * | 3/2003 | Garcia et al. | 222/633 |
| 2004/0012135 | A1 | * | 1/2004 | Abergel et al. | 267/166 |

* cited by examiner

*Primary Examiner*—Gene Mancene
*Assistant Examiner*—Patrick Buechner
(74) *Attorney, Agent, or Firm*—Sughrue Mion, PLLC

(57) ABSTRACT

A fluid product dispenser includes a reservoir (3) containing said fluid product and provided with at least one actuating wall (10) on which pressure is exerted to reduce the reservoir volume, a dispensing orifice (50) communicating with the reservoir and through which the fluid product is dispensed out of the reservoir in a mixture with a gas to create a two-phase spray, a detachable sealing unit (12) to seal the dispensing orifice (50) and so isolate the reservoir from the outside, and a spring (4) to bring the actuating wall (10) into a non-operational position defining the maximum volume of the reservoir (3) when the sealing unit (12) is withdrawn from the dispensing orifice (50), said spring (4) being compressed when the sealing unit (12) seals the outlet orifice (50), the reservoir (3) containing approximately only fluid product so long as the detachable sealing unit (12) seals the dispensing orifice (50).

so long as the detachable sealing unit (12) seals the dispensing orifice (50), the reservoir (3) is divided into several compartments (31, 32; 31', 32') by at least one partition (13; 13'), at least one (31; 31') of the compartments containing the fluid product and at least one other compartment (32; 32') containing the spring (4), but no fluid product, with the result that the fluid product is not in contact with the spring (4) before withdrawal of the sealing unit (12).

10 Claims, 3 Drawing Sheets

FLUID PRODUCT DISPENSER

CROSS REFERENCE TO RELATED APPLICATION

This application claims benefit of Provisional Application No. 60/350,026 filed Jan. 23, 2002; the disclosure of which is incorporated herein by reference.

BACKGROUND OF THE INVENTION

The present invention relates to a fluid product dispenser including:

- a reservoir containing said fluid product and provided with at least one actuating wall on which pressure is exerted to reduce the reservoir volume,
- a dispensing orifice communicating with the reservoir and through which the fluid product is dispensed out of the reservoir in a mixture with a gas to create a two-phase spray,
- a detachable sealing unit to seal the dispensing orifice and so isolate the reservoir from the outside,
- spring means to bring the actuating wall into a non-operational position defining the maximum reservoir volume when the sealing unit is withdrawn from the dispensing orifice, said spring means being compressed when the sealing unit seals the outlet orifice, the reservoir containing approximately only fluid product so long as the detachable sealing unit seals the dispensing orifice.

A fluid product dispenser of this type is particularly described in the document FR-2 791 645. The reservoir of this dispenser is therefore sealed by means of the detachable sealing unit when it contains practically only fluid product and practically no air or no air at all. It then has a particularly flat configuration, especially if a spring is used which adopts a flat configuration when compressed to the maximum. It is only when the detachable sealing unit is withdrawn that air is sucked into the reservoir through the dispensing orifice since the spring means are then able to relax and thus act upon the actuating wall so as to increase the reservoir volume to a maximum state. From this moment on, the reservoir contains a small quantity of fluid product and a much larger quantity of air. Now when the actuating wall is pressed, the reservoir volume diminishes and the mixture of air and fluid product is then forced back in the form of a two-phase spray through the dispensing orifice.

The advantage with a dispenser of this type is that the fluid product inside the reservoir is practically not in contact or not in contact at all with air which could cause deterioration in the qualities of the fluid product. However, the fluid product is in contact with the spring means which may be made of metal or of a plastic material. Depending on the type of fluid product contained in the reservoir, there may be a deterioration in its qualities given its direct contact with the spring means.

BRIEF SUMMARY OF THE INVENTION

The purpose of the present invention is to overcome or at least to lessen the aforementioned drawback of the prior art by defining a fluid product dispenser with a sealed reservoir containing compressed spring means wherein the spring means are not in contact with the fluid product before withdrawal of the detachable sealing unit.

In order to meet this objective, the present invention proposes, so long as the sealing unit seals the dispensing orifice, that the reservoir is divided into several compartments by at least one partition, at least one of the compartments containing the fluid product and at least one other compartment containing the spring means, but no fluid product, in such a way that the fluid product is not in contact with the spring means before withdrawal of the sealing unit. To advantage, said at least one partition is adapted to break in such a way as to bring the compartments into communication with each other under the effect of the relaxation of the spring means after withdrawal of the sealing unit allowing air to penetrate into the reservoir through the dispensing orifice. There is therefore no particular or additional operation in respect of breaking the partition. Moreover, the means bringing about the rupture of the partition are mechanical, namely spring means. And mechanical means of this type have a force or more particularly a stiffness which is predetermined and easily measurable. Consequently, opening the partition to bring the different compartments together is not a random affair, as would be the case is the user were personally to effect the opening of the partition for example by pulling or pressing with one or more fingers. In the present invention, the user needs only to tear off or fold back the detachable sealing unit in order to open the dispensing orifice, which has the effect of triggering the relaxation of the spring means since air is able to penetrate into the reservoir. In this way, it is guaranteed that the partition will always be broken in the same way with given spring means. A particular advantage of the present invention lies therefore in the fact of using the relaxation of the spring triggered by the withdrawal of the detachable sealing unit in order to break the partition separating the spring from the fluid product and thus allow the fluid product and air to spread throughout the reservoir.

According to one characteristic of the invention, the spring means are located in a compartment able to be filled with air coming from the dispensing orifice after withdrawal of the sealing unit. Indeed, in order to allow the spring means to relax, it is necessary for them to be no longer isolated from the outside and for air to be able thereby to penetrate into the compartment where they are located.

According to one embodiment, the spring means are located in a compartment which communicates directly with the dispensing orifice. As a variant, the spring means are located in a compartment separated from the dispensing orifice by a selective partition impermeable to the fluid product and permeable to air. In this case, said selective partition may form a baffle which is impassable for the fluid product, but which nonetheless lets through air.

According to another characteristic of the invention, the compartment containing the spring means also contains a porous material component able to become saturated with fluid product by capillarity. As a variant, the compartment containing the fluid product also contains a porous material component able to become saturated with fluid product by capillarity.

This porous material component is preferably located in direct proximity to the dispensing orifice as is the case in the aforementioned prior art dispenser.

When the fluid product is located in the compartment also containing the porous material component, the compartment containing the spring means is separated from the fluid product compartment by the selective partition.

According to one practical embodiment, the dispenser includes two sheets of film welded together at their peripheries so as to form the reservoir, said at least one partition being formed by one or more low resistance weld lines able to come apart by separation of the sheets, to advantage caused by the relaxation of the spring means after withdrawal of the sealing unit. The weld at the peripheries of the sheets is a definitive weld whereas the weld forming the partition is a much weaker weld able to come apart without damaging the sheets.

BRIEF DESCRIPTION OF THE DRAWINGS

The invention will now be more fully described with reference to the appended drawings giving by way of non-restrictive examples two embodiments of the invention.

In the figures.

DETAILED DESCRIPTION OF THE PREFERRED EMBODIMENT

Figure 2:
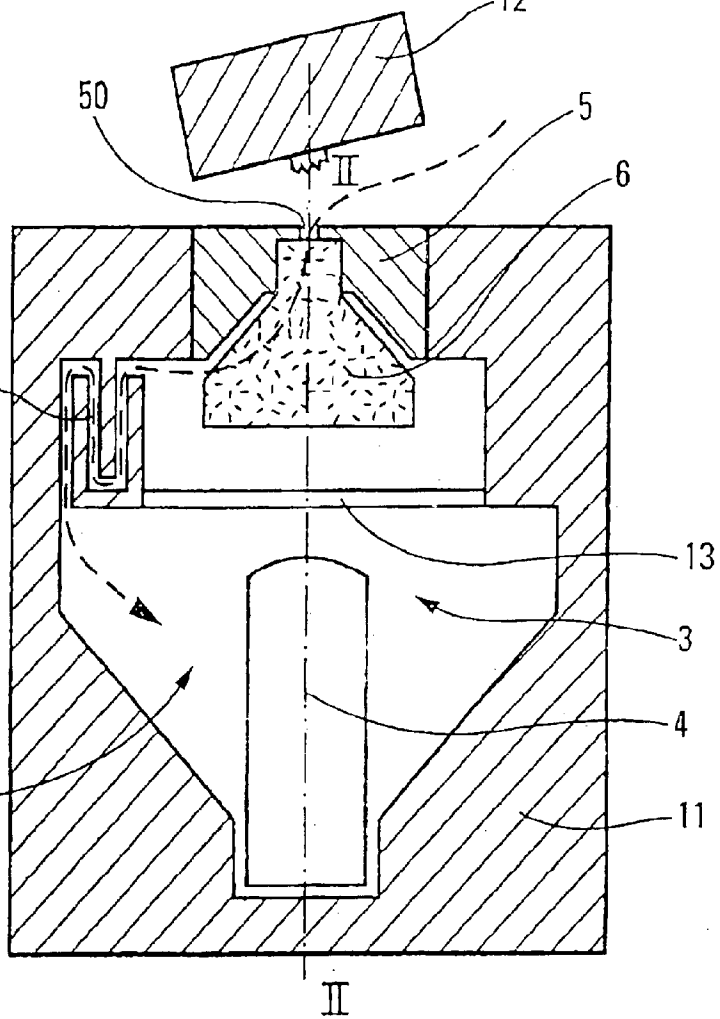
FIG. 2 is a view a similar to FIG. 1 with the detachable sealing unit withdrawn.
Figure 1:
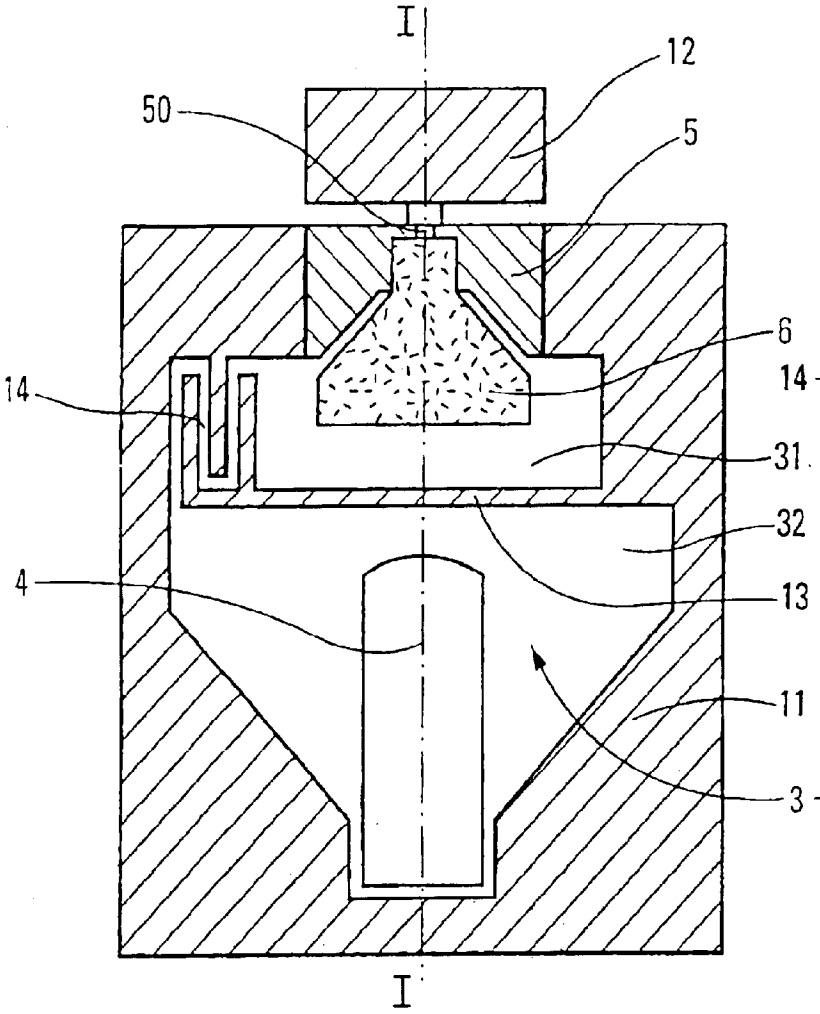
FIG. 1 is a plan view against the light through a fluid product dispenser according to a first embodiment before use, in other words with its detachable sealing unit sealing the dispensing orifice.

In the two embodiments in FIGS. 1, 2 and 4, 5, the dispenser may be made from two sheets of flexible complex film 1 and 2 which are welded together at their periphery 11, 12 so as to define together a volume corresponding approximately to that of a reservoir 3. An insert 5 may also be placed between the two sheets of film 1 and 2: this insert 5 defines a dispensing orifice 50 and a housing in which a porous material component 6 may be housed so as to extend to the inside of the reservoir 3. This component 6 is intended to become impregnated with fluid product contained inside the reservoir 3. Once this component is saturated with product, a flow of air has simply to be passed through the fibre which creates a two-phase dispensing at the level of the dispensing orifice 50 from the insert 5. In front of the dispensing orifice 50, the two sheets 1 and 2 welded together define a tab 12 for tearing or folding which seals the dispensing orifice 50 so as to isolate the reservoir 3 from the outside.

Figure 3:
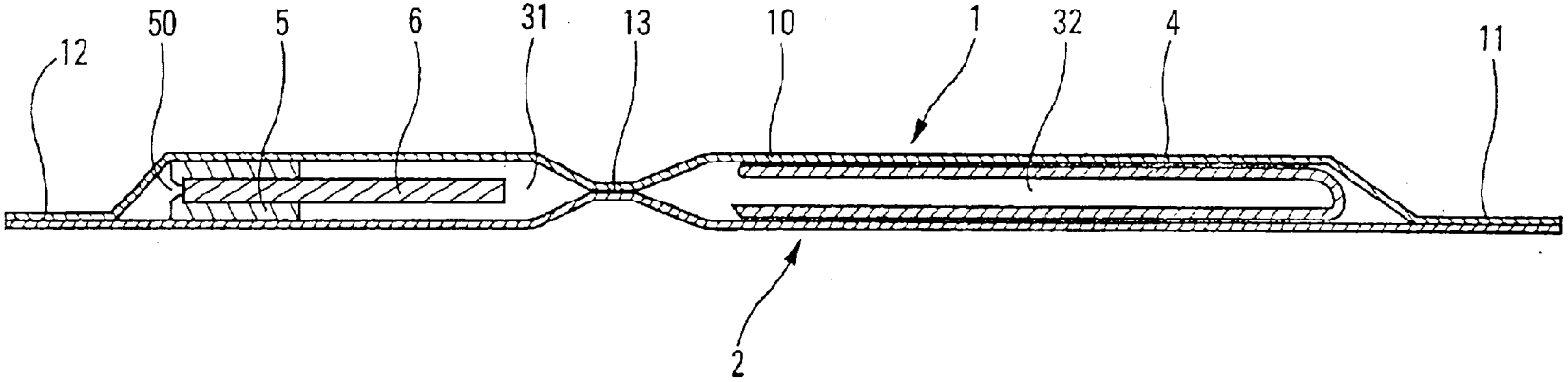
FIG. 3 is a transverse cross-section view through the dispenser in FIG. 1 along the section line I—I.
Figure 4:
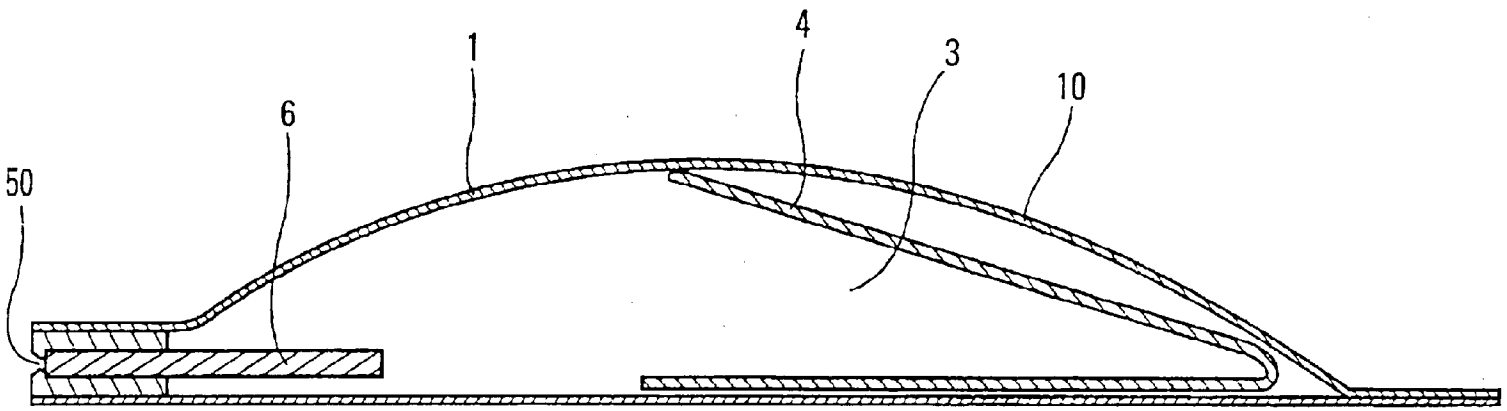
FIG. 4 is a cross-section view through the dispenser shown in FIG. 2 along the section line II—II.

According to the invention, the reservoir 3 contains a spring 4 which is placed between the two sheets 1 and 2. This spring 4, as can be seen in FIG. 4, acts at least on one wall 10 of the dispenser, which can be an actuating wall 10, so as to increase the internal volume of the reservoir 3. According to one particularly advantageous characteristic of the invention, the spring 4 is constrained in its completely compressed state so long as the sealing unit 12 seals the dispensing orifice 50 and thus isolates the reservoir 3 from the outside, as can be seen in FIG. 3. In other words, the reservoir 3 has been sealed during its manufacture with the spring constrained in its maximum compressed state in such a way that the reservoir is then at its minimum volume. Given that the reservoir 3 is perfectly isolated from the outside by the sealing unit 12, the spring 4 is unable to relax inside the reservoir 3 on account of the atmospheric pressure which is exerted on the walls 1 and 2 of the reservoir 3. The dispenser may be stored before use in this state; it then has a particularly reduced thickness which is defined approximately by the thickness of the spring 4 in its completely compressed state added to the concurrent thickness of the two sheets of film 1 and 2. Such a dispenser can for example be inserted into a magazine since it is particularly flat and particularly resistant to pressure.

As soon as the sealing unit 12 is withdrawn, air is able to penetrate inside the reservoir 3 through the dispensing orifice 50 with the result that the spring 4 is able to relax inside the reservoir so as to increase its internal volume. The reservoir 3 is then filled with fluid product and gas, generally air. In order to dispense product in a spray, pressure has merely to be applied to the wall 10 using the thumb for example against the action of the spring 4 so as to the force air back through the component 6 saturated with fluid product. The air passing through the saturated component 6 creates a two-phase spray at the level of the dispensing orifice 50. As soon as the pressure is relaxed on the actuating wall 1, the latter regains its shape shown in FIG. 4 on account of the resilient action of the spring 4.

This is a dispenser in accordance with the document FR-2 791 645.

According to the invention, the reservoir 3 is divided into several compartments by one or more partitions which separate the spring 4 from the fluid product. In this way, there is no contact between them which could damage or cause deterioration in the qualities of the fluid product. Therefore, one of the compartments contains the spring while the other compartment or compartments contains or contain the fluid product.

In the embodiment in FIGS. 1 to 4, there is only one partition 13 which divides the reservoir into two compartments 31 and 32. Compartment 32 contains the spring 4 and no fluid product while compartment 31 contains fluid product.

Figure 6:
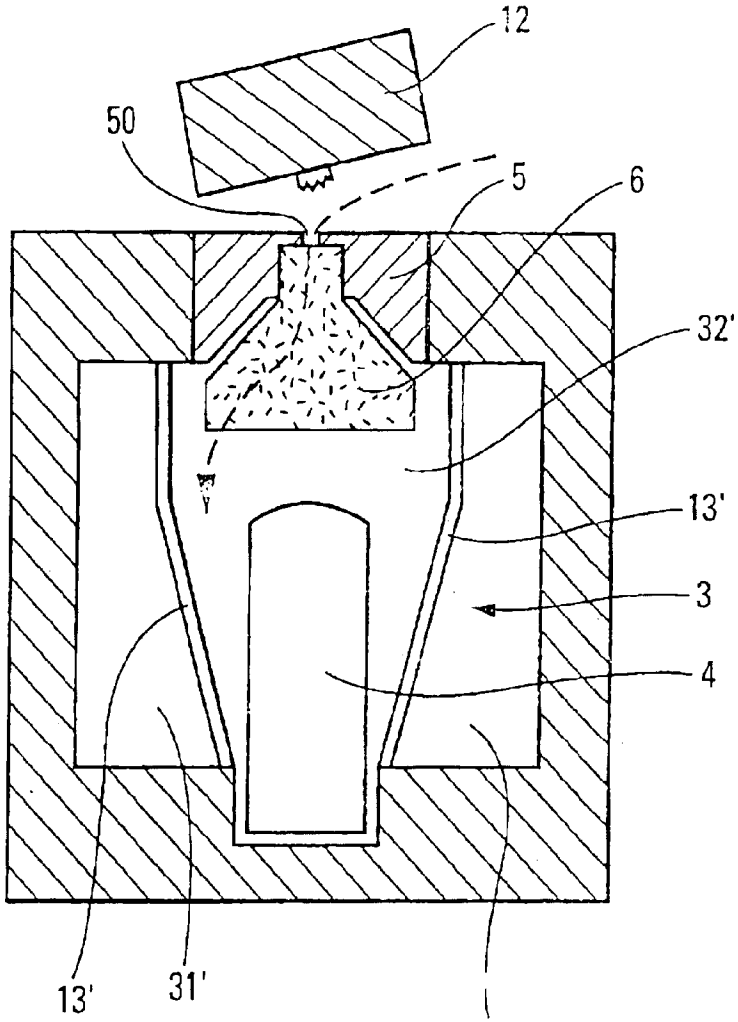
FIG. 6 is a view a similar to FIG. 2 for the second embodiment of the invention.
Figure 5:
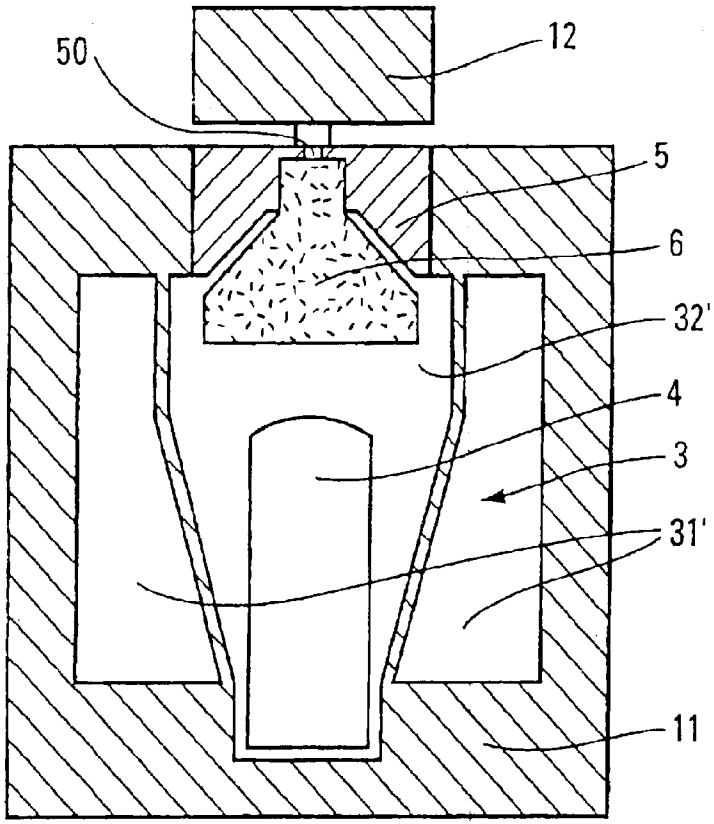
FIG. 5 is a view similar to FIG. 1 of a fluid product dispenser according to a second embodiment of the invention.

In the embodiment in FIGS. 5 and 6, there are two partitions 13' which divide the reservoir into three compartments, namely a central compartment 32' containing the spring 4 and two lateral compartments 31' containing the fluid product.

In the two embodiments, the partitions 13 and 13' are adapted to break so as to bring all the compartments into communication with each other with the result that the fluid product may spread throughout the reservoir. According to the invention, the rupture of the partitions is brought about by the relaxation of the spring 4 after withdrawal of the sealing unit 12 thus allowing air to penetrate into the reservoirs through the dispensing orifice, as explained above. To do this, it is necessary for the compartments containing the spring 4 to be in air communication with the dispensing orifice 50 so as to allow the air coming from the outside to penetrate into the compartment where the spring is located so that it is able to relax.

In the embodiment in FIGS. 5 and 6, the compartment 32 containing the spring 4 communicates directly with the dispensing orifice 50 through the porous material component 6. It may be observed at this point that the spring 4 and the porous material component 6 are located in the same compartment 32'. As for the fluid product, it is stored in the two lateral compartments 31' which are separated from the dispensing orifice 50 by the partitions 13'. It may easily be understood that after withdrawal of the detachable sealing unit 12, as shown in FIG. 6, air, the flow of which is shown in dotted lines, is able to penetrate into the compartment 32' in which is located the spring 4 which is then able to relax. The relaxation of the spring allows the rupture of the adjacent partitions 13' which then brings the compartments 31' into communication with the central compartment 32'. The fluid product is then able to spread throughout the entire reservoir 3, and preferably will saturate the porous material component 6. We then once again have a fluid product dispenser complying with the one in the aforementioned prior art document.

In the embodiment in FIGS. 1 to 4, the compartment 32 containing the spring 4 does not communicate directly with the dispensing orifice 50, since it is separated by the partition 13. It is the compartment 31 containing the fluid product which is in direct communication with the dispensing orifice 50. It may be observed that this compartment 31 also contains the porous material component 6 with the result that the fluid product will preferably become saturated inside this porous material component 6 and remain stored in it. In order to allow air coming from the dispensing orifice 50 to penetrate inside the compartment 32 containing the spring 4, the partition 13 is a selective partition preventing the fluid product contained in the compartment 31 from passing through but nonetheless allowing air to pass from the compartment 30 to the compartment 32 through the selective partition 13. In the embodiment shown in FIGS. 1 and 2, the partition 13 is made selective by means of a baffle or a labyrinth 14 which it is impossible in practice for the fluid product to pass, but which nonetheless allows air to pass to reach the compartment 32. At all events, the fluid product in the compartment 31 is rather inclined to be stored in the porous material component 6 and practically not in the rest of the compartment. Therefore, the possibility is small of the fluid product passing through the baffle 14. The flow of air from the outside through the dispensing orifice 50 to the compartment 32 passing through the baffle 14 is shown in dotted lines in FIG. 2. In response to this introduction of air, the spring 4 relaxes and destroys the selective partition 30 and optionally the baffle 14. We then once again have a dispenser complying with the aforementioned prior art document.

According to the invention, the partitions 13 and 13' may be made by low resistance weld lines which join the sheets 1 and 2 together locally, as shown in FIG. 3. The welding may be such that the spring 4 is able to undo it without damaging the sheets 1 and 2. After relaxation of the spring 4, there is to advantage no further trace of the weld line 13, as shown in FIG. 4.

By means of the invention, the spring is separated from the fluid product before use and the effect of simply tearing off the detachable sealing unit is to relax the spring which breaks the partition or partitions.

What is claimed is:

1. A fluid product dispenser including:

a reservoir (3) containing said fluid product and provided with at least one actuating wall (10) on which pressure is exerted to reduce the reservoir volume, a dispensing orifice (50) communicating with the reservoir and through which the fluid product is dispensed out of the reservoir in a mixture with a gas to create a two-phase spray, a detachable sealing unit (12) to seal the dispensing orifice (50) and so isolate the reservoir from the outside, and spring means (4) to bring the actuating wall (10) into a non-operational position defining the maximum volume of the reservoir (3) when the sealing unit (12) is withdrawn from the dispensing orifice (50), said spring means (4) being compressed when the sealing unit (12) seals the outlet orifice (50), the reservoir (3) containing approximately only fluid product so long as the detachable sealing unit (12) seals the dispensing orifice (50), characterised in that, so long as the sealing unit (12) seals the dispensing orifice (50), the reservoir (3) is divided into several compartments (31, 32; 31', 32') by at least one partition (13; 13'), at least one (31; 31') of the compartments containing the fluid product and at least one other compartment (32; 32') containing the spring means (4), but no fluid product, with the result that the fluid product is not in contact with the spring means (4) before withdrawal of the sealing unit (12).

2. A dispenser according to claim 1, wherein said at least one partition (13; 13') is adapted to break in such a way as to bring the compartments (31, 32; 31', 32') into communication with each other under the effect of the relaxation of the spring means (4) after withdrawal of the sealing unit (12) allowing air to penetrate into the reservoir (3) through the dispensing orifice (50).

3. A dispenser according to claim 2, wherein the spring means (4) are located in a compartment (32, 32') able to be filled with air coming from the dispensing orifice (50) after withdrawal of the sealing unit (12).

4. A dispenser according to claim 3, wherein the spring means (4) are located in a compartment (32') which communicates directly with the dispensing orifice.

5. A dispenser according to claim 3, wherein the spring means (4) are located in a compartment (32) separated from the dispensing orifice (50) by a selective partition (13) impermeable to the fluid product and permeable to air.

6. A dispenser according to claim 5, wherein said selective partition (13) forms a baffle (14) which is impassable for the fluid product, but which nonetheless lets through air.

7. A dispenser according to claim 1, wherein the compartment (32') containing the spring means (4) also contains a porous material component (6) able to become saturated with fluid product by capillarity.

8. A dispenser according to claim 1, wherein the compartment (31) containing the fluid product also contains a porous material component (6) able to become saturated with fluid product by capillarity.

9. A dispenser according to claims 5 or 8, wherein the compartment (32) containing the spring means (4) is separated from the fluid product compartment (31) by the selective partition (13).

10. A dispenser according to claim 1, including two sheets of film (1, 2) welded together at their peripheries (11) so as to form the reservoir (3), said at least one partition (13; 13') being formed by one or more low resistance weld lines able to come apart by separation of the sheets, to advantage caused by the relaxation of the spring means after withdrawal of the sealing unit.

* * * * *